United States Patent [19]

Moreau

[11] 4,041,745

[45] Aug. 16, 1977

[54] APPARATUS FOR CONTINUOUS EXTRUSION

[75] Inventor: Marc Moreau, Asnieres, France

[73] Assignee: Trefimetaux, Paris, France

[21] Appl. No.: 676,908

[22] Filed: Apr. 14, 1976

[30] Foreign Application Priority Data

May 14, 1975 France ..... 75.15733

[51] Int. Cl.[2] ..... B21C 23/00

[52] U.S. Cl. ..... 72/60; 72/262; 72/270; 425/224

[58] Field of Search ..... 72/60, 262, 263, 270, 72/273; 425/223, 224

[56] References Cited

U.S. PATENT DOCUMENTS

| | | | |
|---|---|---|---|
| 2,754,544 | 7/1956 | Bicher | 425/224 |
| 3,308,510 | 3/1967 | Gabrielle | 425/223 |
| 3,736,655 | 6/1973 | Beckman | 72/60 |
| 3,765,216 | 10/1973 | Green | 425/224 X |
| 3,795,964 | 3/1974 | Beckman | 72/60 |
| 3,872,703 | 3/1975 | Green | 72/262 |
| 3,922,898 | 12/1975 | Vorhees | 72/60 |
| 3,934,441 | 1/1976 | Hamilton et al. | 72/60 |

*Primary Examiner*—Leon Gilden
*Attorney, Agent, or Firm*—Dennison, Dennison, Meserole & Pollack

[57] ABSTRACT

A method and apparatus for extruding an object of undefined length capable of plastic deformation into another object of undefined length and smaller section, using the driving forces and the pressure developed in a viscous fluid surrounding the first object by the movement of a mobile member provided with a groove in its surface, the groove defining, together with the surface of a stationary member, a passage along which the first object is displaced towards a die by the action of the forces developed in the fluid by the mobile member.

8 Claims, 7 Drawing Figures

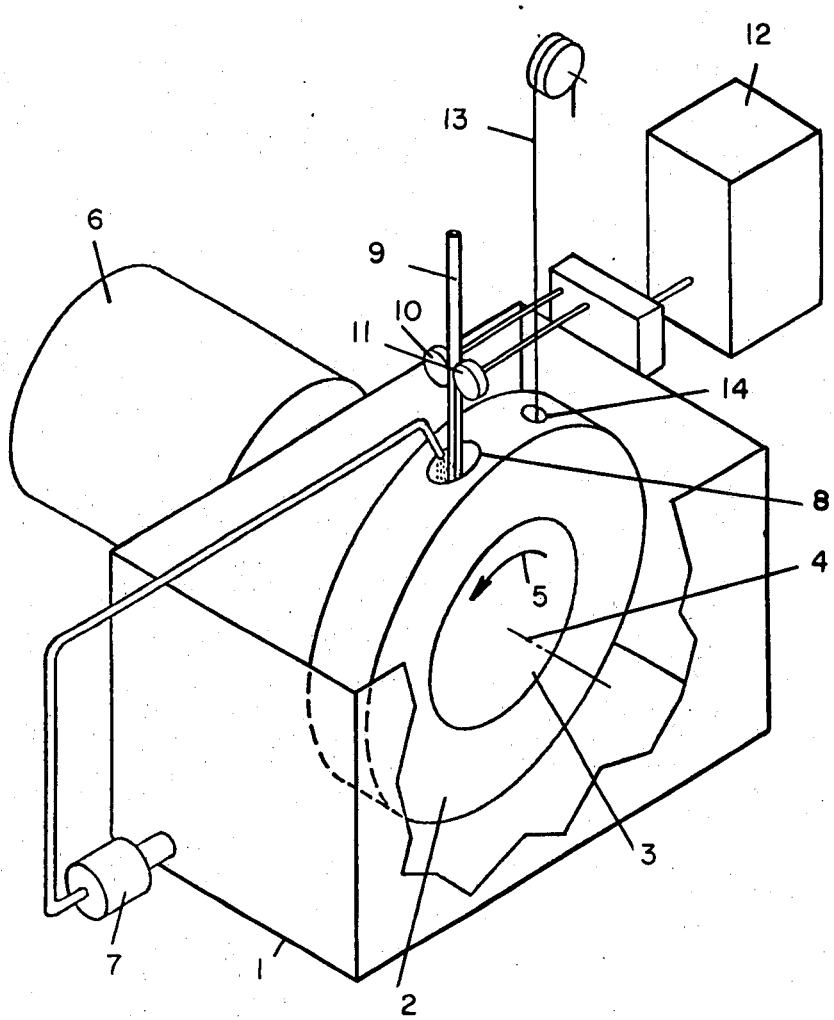

APPARATUS FOR CONTINUOUS EXTRUSION

The invention relates to a continuous method of extruding a first object, which is capable of plastic deformation, which may for example be metallic and which is of undefined length, into a second object of undefined length and smaller section by passing it through a die. The invention also relates to apparatus used in carrying out the method. The invention however, is not restricted to the extrusion of metals.

In their simplest embodiments extruding processes comprise the feeding into the cylinder of an extruder, with the desired die at its outlet, an object shorter than the cylinder and exerting pressure on the object mechanically by means of the piston of the extruder. However, mechanical processes have two types of defects. On the one hand they are discontinuous, since pressure has to be reduced so that a new object to be deformed can be fed into the cylinder; in particular, they do not enable the section of an object of undefined length to be continuously reduced. Another serious drawback of such processes is that when the material passes through the die and when it is extruded in contact with the walls and ends of the cylinder there is friction between the material and the machinery, with two results: heavy wear on the die and a poor surface condition for the extruded object. Various methods have indeed been proposed for reducing the friction and lubricating the die, but such means only attenuate the troublesome phenomena rather than eliminating them altogether.

To enable a material to be extruded continuously through a die, French Pat. No. 72.08481 proposes that the material should be driven and passed through a die by means of the friction between that material and the walls of a groove, which is formed at the periphery of a rotating element and closed by a stationary element along which the moving element is displaced towards the die. The material thus rubs against the four walls of the groove, the friction on the three walls of the groove in the rotating element having a motive action and the friction on the wall of the stationary element exerting a braking action. Apart from the fact that the friction develops a large and sometimes prohibitive amount of heat, such a process does not avoid the above-mentioned disadvantages relating the the wear on the machinery, particularly the die, and the quality of the surface of the product extruded. Moreover the flow of material is asymmetrical; there is a danger that a dead zone may form in the vicinity of the die, in which the flow is almost zero; the surface defects of the object to be drawn will then re-appear inside the object drawn, to which they will give heterogeneous character. Finally, the energy yield is small since the heating due to friction absorbs a large part of the motive energy applied. For some metals these various drawbacks are serious enough to make the process quite unsuitable.

Methods of hydrostatic extrusion have also been proposed, e.g., in U.S. Pat. No. 2,558,035, where the pressure of a piston is replaced by that of a liquid fed into the cylinder of an extruder around the object to be extruded. Such methods can only be discontinuous. Other documents propose various alternate relative movements of a die located at the end of a pressure cylinder and of a piston located at the other end of the cylinder, the object to be extruded passing across the piston. It has also been proposed to vary the pressure in a pressure cylinder so as to create phases during which pressure is sufficient to bring about extrusion, alternating with phases of lower pressure during which a fresh portion of an object to be extruded is fed into the pressure cylinder.

On the other hand it has been known for a long time that the ductility of many metals and alloys increases when they are subjected to an increasing pressure, and that they can be deformed at high pressures without fracturing. P. W. Bridgman has described this effect, known as the "Bridgman effect" in the publication "Large Plastic Flow and Fracture" published by McGraw Hill (New York) in 1952. His U.S. Pat. No. 2,558,035 already mentioned, describes a discontinuous arrangement for extruding a metal through a die which utilizes this effect.

Attempts have been made to utilize the same effect in arrangements for treating an undefined article moving in cylinders which are larger in diameter than the object to be extruded. Thus U.S.S.R. Inventor's Certificate No. 176,229 describes a method and apparatus in which the object to be extruded passes through an elongated cylinder closed by a die which defines the desired section; a pressurized liquid circulates through the cylinder towards the die, around the object to be extruded, drives the object towards the die and forces it through. Such a procedure, where maximum pressure is developed at the inlet of the cylinder rather than in the vicinity of the die, does not enable high reduction ratios to be obtained, since the object would be fractured by constriction on entering the cylinder.

French Pat. No. 70.02877 discloses an arrangement described as "having alternating flow with reverse changes," wherein the object to be extruded passes along a cylinder comprising a plurality of sections separated by radial walls, each of the cylindrical sections having a diameter at least twice that of the object to be extruded. A viscous liquid is fed at high pressure into the section closest to the die. In each of the sections the liquid circulates towards the die, around the object to be extruded, and passes from the downstream portion of one section to the upstream portion of the section which precedes it in the path of the wire being extruded. In this way a longitudinal effort in the direction of the die is exerted in each section, and a transverse effort is also exerted and increases the ductility of the wire, as also happens in the process described in above-mentioned U.S.S.R. Inventor's Certificate No. 176,229. In these arrangements the driving fluid is moved by a pump outside the arrangement, without any part of the arrangement being displaced relative to the other parts. The whole unit is complex and has a very low energy yield.

The subject matter of this invention is a process and relatively simple means for continuously converting a first object of undefined length into a second object of undefined length and of any section small than that of the first. The process utilizes both the improvement in the ductility of the material due to a very high pressure exerted on the first object, and the high viscosity of a material surrounding the first object until it passes through a die. The viscosity enables a mobile member partially surrounding the fluid to create in the fluid a high pressure and forces for driving the first object towards a die.

In the process of the invention the first object is shaped to create two plane, parallel surfaces, referred to as "flats." The difference between the flats is kept constant along the object with very great accuracy, which may in some cases be up to 0.001 mm. The object thus shaped and a viscous fluid surrounding it over its whole surface are fed into a passage. The passage comprises a revolving groove which is deeper than it is wide and is formed in the surface of a revolving member in rotation, with two lateral surfaces substantially plane and equidistant, and closed by the surface of a stationary cooperating member co-axial with the first. The stationary member carries a stop extending into the groove, which it closes, and at least one die. Tangential forces are developed in the fluid by the rotary movement of the mobile member and by cooperation between the plane faces of the first object, the lateral walls of the groove and the viscous fluid separating them. The fluid transmits these forces to the first object, with the result that the object is urged towards the stop and through the die and that a pressure is produced which increases in the direction of the die and gradually improves the ductility of the first object.

Thus in the method of the invention the whole periphery of the object to be extruded is subjected to a pressure which increases in the direction of the die, giving it maximum ductility in the vicinity of the die. Cooperation between the two plane lateral surfaces of the groove and the corresponding plane surfaces of the object to be extruded, by way of a film of viscous fluid, develops tangential forces which cause the object to be extruded to be thrust towards and through the die. The closer the cooperating surfaces of the object and groove, and thus the thinner the film of viscous liquid between those surfaces, the stronger are the forces.

The wall of the stationary member forming the fourth wall of the passage clearly exerts a reverse effort and creates tangential forces which are opposed to those developed by the cooperating surfaces of the groove and first object. However, it should be noted that the areas of contact between the fourth wall and the fluid and between the fluid and the surface facing towards the first object are smaller than the sum of cooperating plane surfaces of the groove and first object. This is so even if the effect of the plane surfaces is assessed without including the effect of the possibly less close cooperation between the bottom of the groove and the surface of the first object facing towards the bottom.

Furthermore, since the groove is deeper than it is wide and since the distance between the object and the stationary wall is relatively large and in particular is greater than the distance between each of the plane surfaces of the object and the cooperating lateral wall of the groove (which is a feature of the method of the invention) the strength of the reverse forces exerted on the first object due to the presence of the fourth wall of the passage is considerably reduced.

Another result of the presence of a fluid completely surrounding the first object is that direct friction is avoided between the object and the walls of the passage within which it is accommodated. The elimination of direct contact between the first object and the walls of the passage makes it possible to impose very severe limitations on the heating of the object being converted and of the apparatus and on the energy losses which such heating represents.

It is also clearly important to choose a liquid which has a very high viscosity at the final operating temperature and to choose the liquid according to the nature of the objects being treated by the process and according to the desired reduction ratio. Fluids with a viscosity as high as 500 stokes or more may be suitable.

The pressure created at each point in the passage by rotation of one of the members increases with the speed of rotation; its maximum level is chosen according to the nature of the material being processed. The rotary speed is made higher — all other conditions being equal — the higher the reduction ratio required, since this necessitates higher pressures and tangential forces. Pressures of up to about 15,000 bars or more may be applied.

The use of pressures of this order in a space defined partly by a stationary member and partly by a mobile member obviously necessitates accurate machine-finishing, with a view to limiting leakages of fluid through the clearance required between the members moving relative to one another. The apparatus for carrying out the method of the invention must include arrangements for limiting leakages of fluid during operation and possibly for compensating for them.

The invention also concerns apparatus for carrying out the method. These essentially comprise means for shaping the object to be extruded so as to give it two plane, substantially parallel surfaces or flats, a constant distance away from one another, the flats being shaped with a very high degree of accuracy which may in some cases be up to 0.001 mm; a unit comprising a co-axial rotor and stator cooperating at one of their surfaces; one of these carrying in its surface a groove with two plane lateral surfaces substantially parallel with one another and perpendicular to the surface of the member, the distance between the lateral surfaces exceeding the distance between the flats by twice an amount ranging from 0.001 to 0.1 mm; and the other carrying a step which extends into the groove and forms the fourth wall of an undefined passage, a stop which closes the groove and passage and a die enabling the second object to be discharged; the lateral surfaces of the step cooperating with the external part of the lateral surfaces of the groove while leaving the smallest possible clearance between them and the latter; the depths of the groove and step being such that the depth of the passage formed by their cooperation exceeds the dimension of the first object, once shaped, in a direction parallel with its flats, by at least three times the distance between a flat and the corresponding lateral surface of the groove; means for circulating viscous fluid and for feeding it into the passage formed between the rotor and stator; and finally a storage tank for viscous fluid, receiving the inevitable leakage resulting from the clearance between rotor and stator.

The arrangements according to the invention can be embodied in several ways with regard to the shape and relative position of the two co-axial members which move relative to one another and form the desired passage. In a first embodiment the rotor and stator cooperate at two surfaces perpendicular to the axis of rotation and facing towards one another. One of them carries a revolving groove each of the two lateral walls of the groove forming a cylindrical surface, the axis of which is the axis of rotation. The other carries a step which extends into the groove and the lateral surfaces of which cooperate with the lateral walls of the groove with a very small clearance, a stop which closes the groove and a die in the vicinity of the stop. The component carrying the groove may be either the rotor or the stator.

In another embodiment one of the rotor or stator members surrounds the other. The groove is formed at the periphery of one of them, at the external periphery of the member surrounded or at the internal periphery of the surrounding member. The other member carries the step, stop and die.

The level of fluid in the tank receiving it is immaterial; it may even be above the upper level of the cooperating members, which would then operate in an immersed state. Means for cooling the fluid may be arranged along its path or in the tank. The operating temperature may be chosen as desired, allowing for the nature of the object being converted and that of the viscous fluid used.

In order to more clearly understand the invention and its operation, an arrangement in which one of the members encloses the other and in which the rotor is the enclosed member will now be described more completely by way of example. However, a section through an arrangement where the rotor and stator cooperate at the surface perpendicular to the axis of rotation will reveal the similarity between the conformation of the members in the two embodiments.

In these various figures members with the same function carry the same reference.

Figure 1:
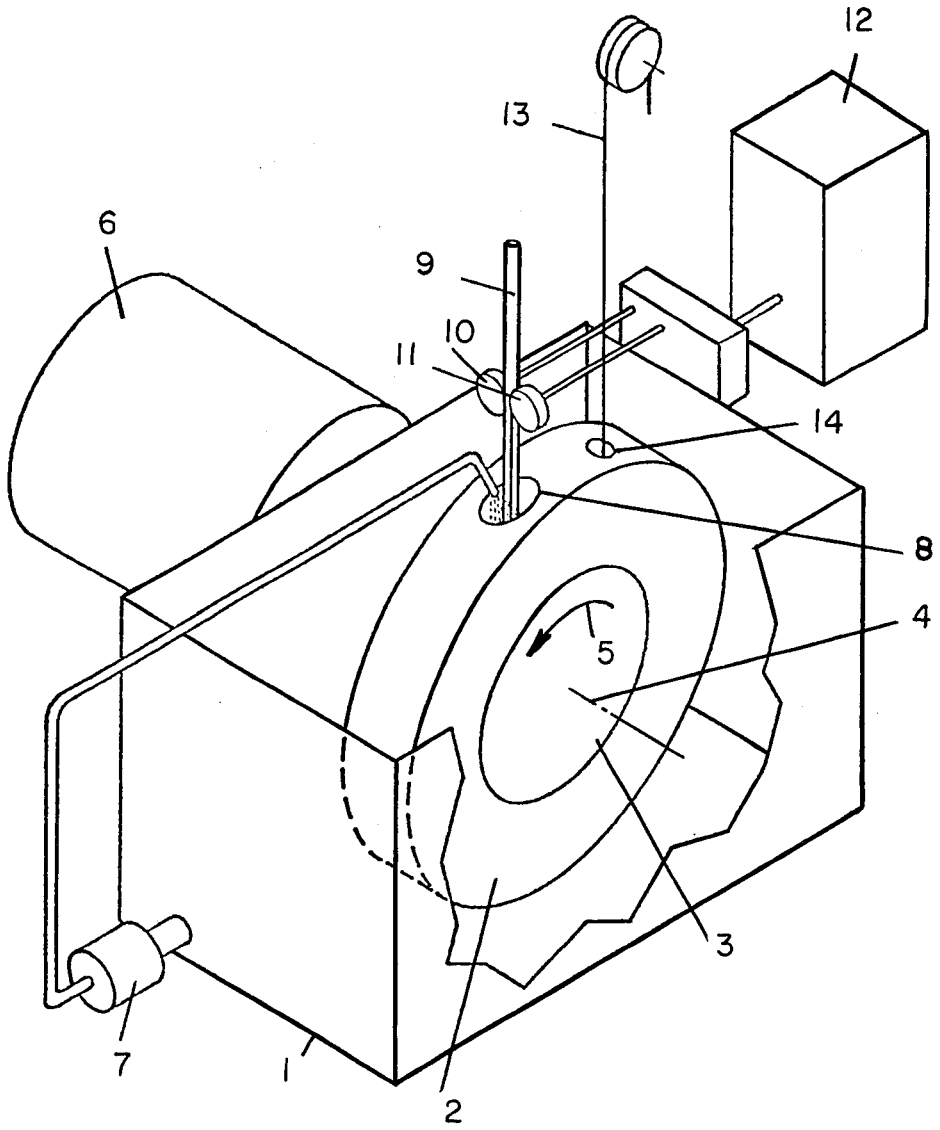
FIG. 1 is a perspective view of the apparatus according to the invention, wherein one of the members which cooperate to form the passage through which the object to be extruded and the viscous fluid pass surrounds the other member cooperating to the same end.

Referring now to FIG. 1, this shows a container 1 which may be open at the top so as to form a tank of viscous fluid, a flat, stationary sleeve 2, and a rotor 3 which turns inside sleeve 2 with a very small clearance between them, about an axis 4 which is common with the axis of sleeve 2; the rotor is driven in the direction of arrow 5 by a motor 6, preferably a variable speed motor. A pump 7 circulates the viscous fluid from tank 1 to a port 8 where it enters sleeve 2. Means (not shown) may be used for coating the first object. The object 9 to be extruded is of any section and is inserted in port 8 after passing between two rollers 10, 11, which are driven by means known per se and shown diagrammatically at 12. The position of the rollers and the distance between them relate to the position of the opposed surfaces of the groove in rotor 3 and the distance between them, as will be explained later. Other means may be used to obtain the same shaping effect. When the object to be extruded has been shaped its thickness must, as already explained, be in proportion to the width of the passage, which will be described later. The object extruded 13 emerges through a port 14.

Figure 2:
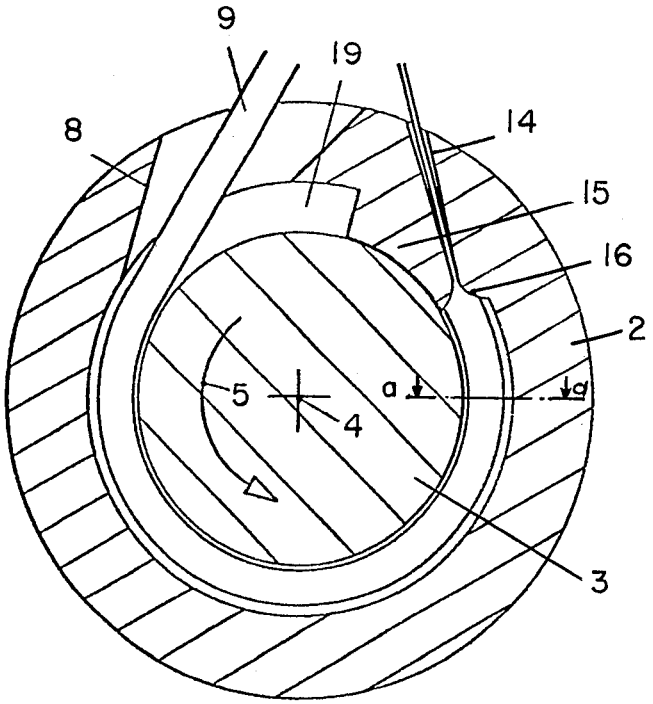
FIG. 2 is a section through the two cooperating members, extending through a plane perpendicular to their common axis and passing through the passage.
Figure 3:
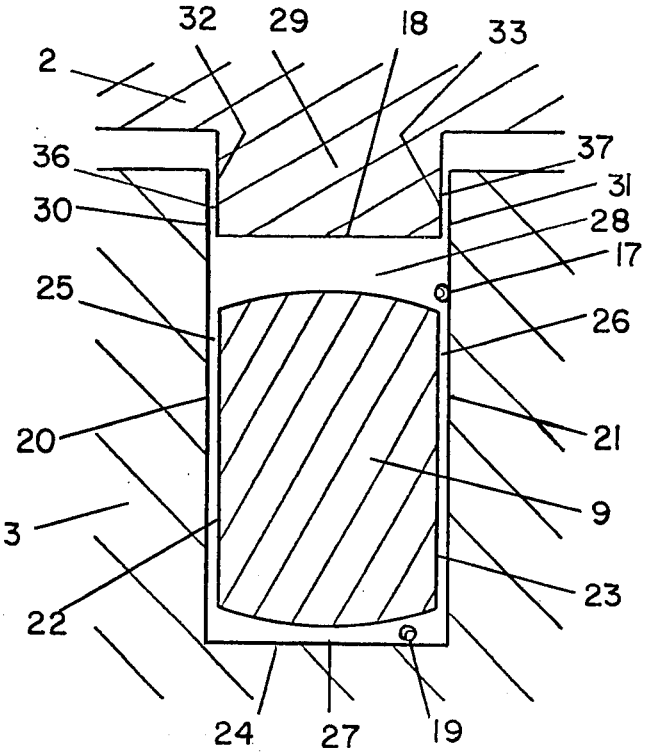
FIG. 3 is a section through the passage, shown at *a—a* in FIG. 2.

The internal shape of the rotor and stationary sleeve and the position of the die can be seen from FIGS. 2 and 3. FIG. 2 shows sleeve 2 with a stop 15 fixed rigidly to its internal surface. The stop forms a die 16, the outlet port of which corresponds to port 14 of sleeve 2. The object 9 to be extruded is fed into port 8 of sleeve 2, which leads into a passage 19 formed by the rotor-stator unit. The shape of the passage can be seen more clearly from FIG. 3 in its simplest embodiment. This figure shows a groove 17 at the periphery of rotor 3. Together with the opposed surface 18 of sleeve 2, groove 17 defines a passage 19 which accommodates the object 9 in the course of extrusion, surrounded with viscous fluid on all its surfaces. As already stated, the distance between the two opposed surfaces 20 and 21 of groove 17 is only very slightly greater than the distance between the two flats 22, 23 on object 9; accuracy is less important for the distances from the two other surfaces of object 9 to the surface of the base 24 of the groove and to the surface 18 of sleeve 2; as already mentioned, however, this last distance is considerably greater than the distance from flats 22, 23 on the object to the corresponding surfaces 20 or 21 of groove 17. Surfaces 20 and 21 and flats 22, 23 on the object have been shown as being strictly flat; they may be slightly curved, provided that their respective curvatures enable them to cooperate, and provided that the width of the inlet to the groove is at least equal to the maximum distance between the flats on the object.

A sheath of viscous liquid is provided around the object. Portions 25, 26 of the liquid are thin, e.g., 0.001 to 0.1 millimeter thick; portion 27 at the bottom of groove 17 is of any thickness and in practice thin and uneven; portion 28 between the object treated and surface 18 is thick, at least three times thicker than portions 25, 26.

It has been indicated that the stationary surface forming the fourth side of passage 19 is that of sleeve 2. The clearance between the rotor and stator, through which the viscous fluid leaks, is thus along the external surface of the rotor. Since the stator undergoes resilient deformation which varies at each point as a function of the pressure developed at that point, the clearance during operation is greater than the clearance at rest, and the clearance at rest must be sufficient to prevent the rotor from applying friction to the stator when the apparatus is started up and before operating pressures are obtained.

It is preferable for the stationary surface which forms the fourth wall of passage 19 to be surface 18 of a step 29 carried on stator 2 and engaging in groove 17. The clearance between the rotor and stator is then in planes perpendicular to the axis of rotation between portions 30, 31 of the lateral surfaces of groove 17 and lateral surfaces 32, 33 of step 29. In such a preferred arrangement the dimensions of the clearance are changed very little by the plastic deformation of the stator resulting from the pressure developed at each point in a period of operation.

The operation of the arrangement just described will be easily understood. Rotor 3 is set in rotation in the direction of arrow 5, and the end of the object 9 of undefined length to be extruded is inserted between rollers 10, 11. The rollers are driven by means 12; they form the desired flats 22, 23 on object 9 and push it through port 8 into passage 19. Pump 7 is set in action and viscous fluid is fed simultaneously into port 8 and passed into passage 19 around the object being extruded. The friction of surfaces 20, 21 against layers of fluid 25, 26 develops tangential forces in the fluid; these forces are transmitted by the fluid and drive the object towards and through the die. At the same time, since the fluid being driven can escape only partially through the die, it is compressed. As a result pressure is exerted around the first object; the pressure increases in the direction of arrow 5 and reaches its maximum value at the level of the die.

It should be noted that as soon as an adequate length of the first object has been fed into passage 19 the pull exerted on the object at the level where it enters port 8 may be strong enough to shape and deliver it without rollers 10, 11 exerting a motive thrust force.

The parameters for an arrangement capable of driving the object in the direction of the die despite an increasing hydrostatic pressure in that direction can easily be deduced from Poiseuille's Law. If $j$ is the clearance between a surface 20 or 21 and the cooperating flat 22 or 23, $l$ is the width of a flat in a direction perpendicular to the axis of rotation, L is the useful length of passage 19 between inlet 8 and die 16, $\mu$ is the mean viscosity of the fluid under working conditions, $v$ is the difference between the rotary speed of the rotor and the speed at which object 9 progresses, then, if in a first approximation forces due to the presence of the other surfaces 24 and 28, which on an average are further away from the object, are ignored, the force driving the object will be:

$$F = 2\,(L\,l\,\mu\,v/j)$$

Since the fluid driven by the movement of the rotor cannot escape freely it is compressed by the stop against which it abuts, apart from any leakages between the elements in relative movement; these leakages depend at each point on the pressure level at that point. In normal operation the pressure is such that there is a balance between the total flow rate of the leakages and the flow rate of the fluid supplied; the flow rate of the leakages increases at the same time as the pressure, and that of the fluid supplied increases with the rotary speed of the rotor, all other conditions remaining equal.

By way of examle, the pressures required are of the order of 15,000 bars if a reduction ratio of 50/1 is to be obtained from a first object made of copper and introduced at ambient temperature.

If the product treated and the reduction ratio required necessitate such high pressures that the leakages between the rotor and stator make it difficult to obtain these pressures, special measures will have to be taken. Some of these measures will now be described.

Figure 5:
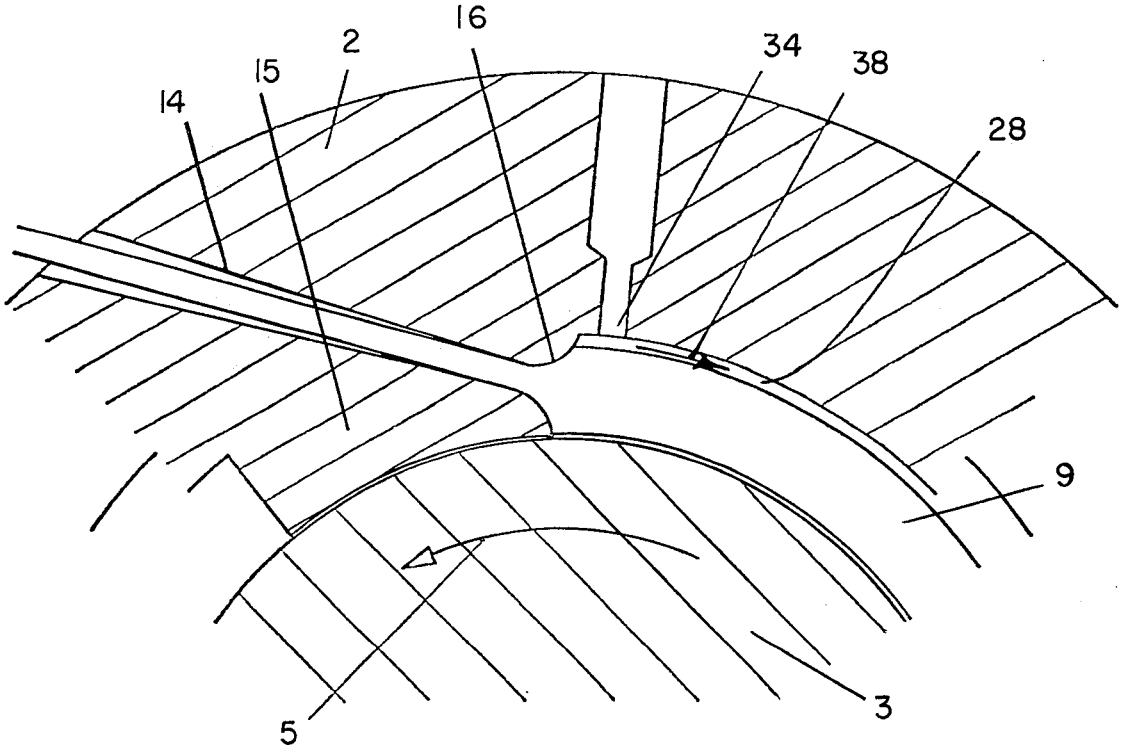
FIG. 5 shows an alternative to the arrangement in FIG. 2, and represents a means which can be used to compensate for leakages of viscous fluid by introducing a fraction of the fluid in the vicinity of the die.

For example, it is possible for viscous fluid to be introduced, in the vicinity of the die, into the stream of viscous fluid 28 which surrounds the object being extruded, at the maximum desired pressure, e.g., through a port 34 formed through the stator as represented in FIG. 5. From the point of introduction 34 a slight current of viscous fluid is created in the stream, in the direction of arrow 38, to the point where the fluid supplied by the rotary movement of the rotor ceases to be greater than the leakages between the rotor and stator in the section between that point and the point of introduction 34.

Figure 6:
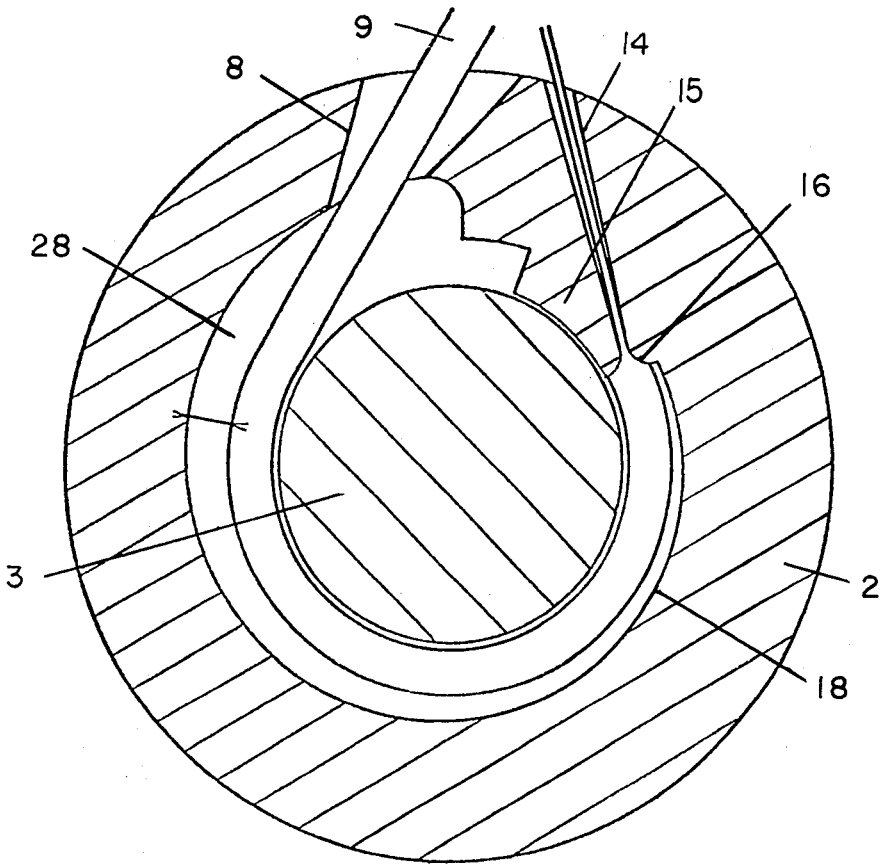
FIG. 6 shows an arrangement similar to that in FIG. 2, where the passage has a special conformation making it possible to compensate for leakages of viscous fluid.
Figure 7:
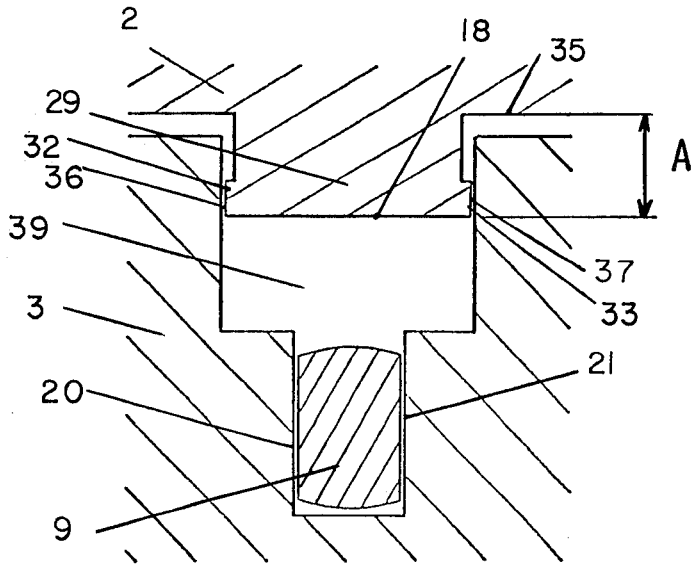
FIG. 7 shows a special embodiment of the groove and step, enabling the leakages of viscous fluid to be restricted.

Another means, which is bound up directly with the conformation of passage 19, is shown in FIGS. 6 and 7. In FIG. 6 it is clear that the thickness of the stream of fluid 28 between the first object and stationary surface 18 decreases progressively from the point of introduction of the first object to the die. This result can be obtained (as shown in section in FIG. 7) by making groove 17 deeper and by shaping step 29 so that its depth A from internal surface 35 of the stator increases progressively from the inlet port for the first object to the die. If the stator is shaped in this way more viscous fluid can be fed in.

In a modified embodiment of this conformation of the stator, the external portion 39 of groove 17 may be made wider than the internal portion designed to receive and drive the first object, as shown in FIG. 7.

It should be noted that the figures represent die 16 in the cross-section of stop 15, with the second object emerging virtually at a tangent to the rotor. It is not essential to have such an arrangement. The die may be located on surface 18 and the outlet port may point in any desired direction. The die may be machined in the body of the stop or of the stator or may comprise a separate, detachable or non-detachable element. The active part of that element may be made of a hard material such as metal carbide or the like, diamond, etc. Furthermore a plurality of dies may be provided.

Similarly, the fluid feed has been shown in its simplest embodiment in the figures, i.e. with the delivery pipe of pump 7 discharging into port 8. Without going beyond the scope of the invention one could use other feed arrangements, e.g., a coating box located between rollers 10, 11 and port 8 in the path of the object to be extruded. As already stated, the fluid may be fed by immersing the rotor-stator unit in the mass of fluid present in the tank.

Figure 4:
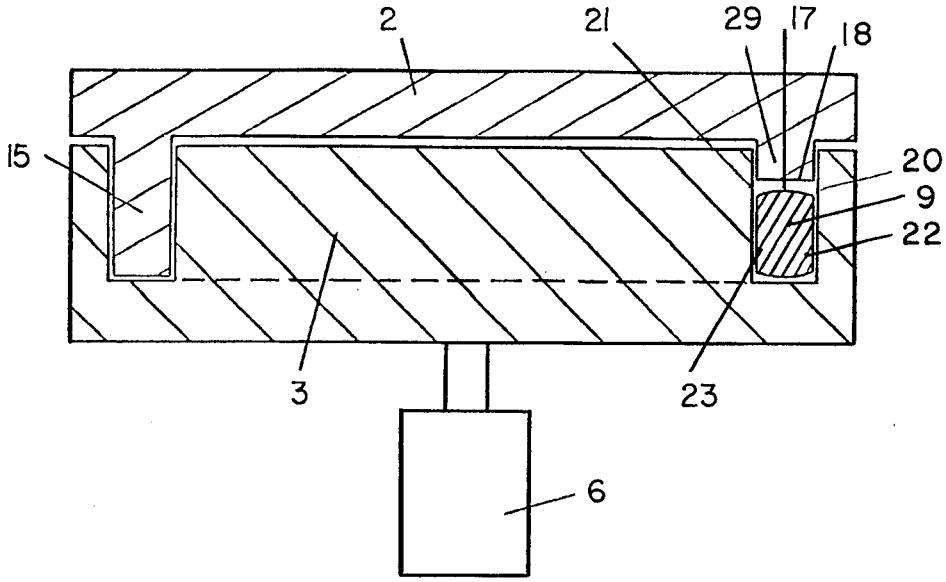
FIG. 4 is a section through two members cooperating to form the passage, in the case where the groove is formed on a surface of one of the members, perpendicular to their common axis.

FIG. 4 is a section taken through the axis of rotation and the stop of an arrangement according to the invention, in which the two co-axial members in relative movement have the ends which are perpendicular to their axis facing towards one another; groove 17 is formed in the surface of one of them. In FIG. 4 the rotating member is the one which carries the groove, while the stationary member carries the step.

This figure again shows motor 6 driving rotor 3, stator 2 equipped with stop 15, the object being extruded 9 and step 29 rigidly connected to stator 2. Again it shows surface 18 of step 29 forming the fourth wall of the desired passage and flats 22, 23 on object 9 cooperating with parallel surfaces 20, 21 of groove 17 by means of the sheaths of viscous fluid. The step and the groove may be of the shapes shown in FIG. 4, which are similar to those in FIGS. 2 and 3, or the shapes shown in FIGS. 6 and 7.

It may be useful to provide means for controlling the speed of the rotor. This determines not only the tangential drive forces but also the pressure finally obtained at the level of the die and the pressures at the intermediate points. A speed too high for a given material being extruded and too high for the desired reduction ratio would lead to excessive pressure, causing the object being extruded to be fractured through construction by excessive hydrostatic pressure insufficient to give the object being extruded the ductility necessary for the desired reduction ratio; the object being extruded would swell abnormally, thus driving away the fluid which should surround the object in this process.

The control means used may be the measurement of dissymmetries relative to the external, stationary or rotating member during operation. It has been explained that, in this process, pressure increases progressively from the port where the object enters passage 19 to the die, and that this pressure depends on the rotational speed of the rotor, all other conditions being equal. The fluid thus exerts centripetal forces at each point of the surface of the external member which cooperates to form passage 19 and on the whole of that member. At each point these forces result in resilient deformation of the member, which becomes more marked closer to the die, and in a force exerted on the axis of rotation in the direction of the resultant of all the forces. Using means known per se, such as a strain, displacement or force gauge, one can thus measure a variable dependent on the difference between the forces undergone at different points on the external member or between the deformations brought about. With the aid of this measurement one can control the rotary speed of the motor and set it to the desired value.

Another control means comprises placing a discharge valve adjusted to the desired pressure in the vicinity of the die.

As an example, a requirement was to obtain a square profile with sides measuring 0.6 mm from a copper wire 2 mm in diameter, wound on a reel. The starting wire passed between two rollers 10, 11 to form two parallel flats 1.400 mm apart. After passing between the flats the wire was fed into the passage of an apparatus such as that shown in FIGS. 1 to 3, at the same time as some viscous fluid. The cooperating flat surfaces of the passage were 1.405 mm apart and the passage was 3 mm deep. The viscous fluid had a viscosity of 500 stokes at ambient temperature and pressure. The rotary speed of the ring 2 was 60 revolutions/minute. The pressure in the vicinity of the die was approximately 10,000 bars.

In another example an arrangement like that in FIGS. 6 and 7 was used, wherein the depth of the passage decreased towards the die. A copper wire 1 mm in diameter was treated to obtain a cylindrical wire 50 times smaller in section. The wire passed between two rollers 10, 11 to form two flats 0.700 mm apart. Then the wire was fed into the passage of the apparatus at the same time as some viscous fluid. The flat surfaces of the groove were 0.710 mm apart; the distance between the bottom of the groove and the internal surface of the step ranged from 16 mm near the inlet for the wire to 1.5 mm near the die. The viscous fluid had a viscosity of 500 stokes at ambient temperature and pressure. The speed of the rotor was 60 revolutions per minute.

From the description just given the method of the invention can be seen to have many advantages. It is absolutely continuous. It avoids any metal-metal contact between the object being converted and the machinery, thus enabling the object extruded to have an excellent surface condition, avoiding any serious wear on the machinery and restricting energy consumption. There is no danger of any surface faults on the first object reappearing inside the object extruded. Finally, although the dimensions of the object to be extruded must correspond to those of the passage, and although the two members in relative movement require accurate machine-finishing, the machinery for working up into shape remains simple.

What is claimed is:

1. Apparatus for continuous extrusion of a first elongated object of indefinite length into a second object of the same type but of smaller cross section comprising, a unit defined by two co-axial members, one of said members being a rotor, and being driven by a motor and said other member being a stator, said members defining a four-sided passage between them, a groove formed in the surface of said rotor to define three sides of said passage, the opposed surface of the stator defining the fourth side of the passage, stop means carried by the stator to close the passage and an outlet die port in said stator near said stop means, an inlet port in said stator located at a position removed from said stop means and a die port, roller means including a pair of spaced rollers for forming a pair of substantially plane and parallel flats on said object to be extruded before it enters said inlet port, the said passage having two opposed sides which are substantially plane and parallel surfaces, the distance between them exceeding the distance between the rollers forming the said flats on the object by twice a quantity ranging from 0.001 to 0.1 mm, the depth of the passage, in a direction parallel to its lateral surfaces, exceeding the dimensions of the object to be extruded in that direction by at least three times the distance between a flat on the object to be extruded and the cooperating side of the groove, means for storing a supply of viscous fluid and means for feeding said fluid into the passage around the object to be extruded.

2. Apparatus as defined in claim 1 wherein the fourth side of said passage is formed by a step rigidly connected to said stator and extending into the groove, the necessary clearance between the stator and rotor being between the lateral walls of said step and those of the groove.

3. Apparatus as defined in claim 2 wherein said step has a thickness which increases progressively from said inlet port to said die port.

4. Apparatus as defined in claim 1, wherein die means are carried by said stop means.

5. Apparatus as defined in claim 2, wherein die means are formed as ports through said step.

6. Apparatus as defined in claim 4, wherein said die means has an active portion formed of a hard material.

7. Apparatus as defined in claim 5, wherein said die means has an active portion formed of a hard material.

8. Apparatus as defined in claim 1, wherein said viscous fluid is introduced in the vicinity of said die port at high pressure into the space around the object.

* * * * *